United States Patent [19]

Cattell et al.

[11] Patent Number: 4,496,610

[45] Date of Patent: Jan. 29, 1985

[54] ELECTROLUMINESCENT PANELS AND METHOD OF MANUFACTURE

[75] Inventors: Alan F. Cattell; Brian Cockayne, both of Malvern; Peter J. Wright, Lower Wick; John Kirton, Malvern, all of England

[73] Assignee: The Secretary of State for Defence in Her Britannic Majesty's Government of the United Kingdom of Great Britain and Northern Ireland, London, England

[21] Appl. No.: 477,853

[22] Filed: Mar. 22, 1983

[30] Foreign Application Priority Data

Mar. 25, 1982 [GB] United Kingdom ..... 8208734
Oct. 18, 1982 [GB] United Kingdom ..... 8229683

[51] Int. Cl.[3] ..... B05D 5/06; B05D 5/12

[52] U.S. Cl. ..... 427/66; 427/126.1; 427/157; 427/255.2; 427/419.7

[58] Field of Search ..... 427/64, 66, 126.1, 126.2, 427/157, 255.2, 419.7; 313/498, 503, 504; 252/301.6 R, 301.6 S

[56] References Cited

U.S. PATENT DOCUMENTS 4,181,753 1/1980 Fischer ..... 427/64

FOREIGN PATENT DOCUMENTS 2432503 2/1975 Fed. Rep. of Germany .
3292399 1/1982 Fed. Rep. of Germany .
1300548 12/1972 United Kingdom .
1571620 7/1980 United Kingdom .

OTHER PUBLICATIONS

Alder et al.: "An Investigation of the Electrical and Optical Properties of DC Electroluminescent ZnS:Mn, Cu-Powder Panels, IEEE Transactions on Electron Devices, vol. ED-28, No. 6, Jun. 1981, pp. 680-688.

Yang et al.: "Studies of Temperature Effects in AC Thin-Film EL Devices," IEEE Trans. on Elec. Dev., vol. Ed-28, No. 6, Jun. 1981, pp. 703-707.

Okamoto et al.: "Low-Threshold-Voltage Thin-Film Electroluminescent Devices," IEEE Trans. on Elec. Dev., vol. Ed-28, No. 6, Jun. 1981, pp. 698-701.

*Primary Examiner*—Norman Morgenstern
*Assistant Examiner*—K. Jaconetty
*Attorney, Agent, or Firm*—Cushman, Darby & Cushman

[57] ABSTRACT

A method in which a phosphor film of manganese doped zinc chalcogenide is produced by chemical vapor deposition from alkyl zinc vapor and the gaseous hydride of the chalcogen. The manganese dopant is introduced uniformly during deposition by decomposition of tricarbonyl alkylcyclopentadienyl manganese:

where here R denotes the alkyl radical. Preferably dimethyl zinc and tricarbonyl methylcyclopentadienyl manganese are used.

The phosphor produced may be one of the following manganese doped compounds: zinc sulphide, zinc selenide, zinc sulphur selenide, zinc oxy-sulphide, zinc oxy-selenide or zinc cadmium sulphide.

7 Claims, 5 Drawing Figures

ELECTROLUMINESCENT PANELS AND METHOD OF MANUFACTURE

TECHNICAL FIELD

This invention concerns electroluminescent panels and their manufacture, particularly, although not exclusively, electroluminescent panels incorporating, between electrode bearing substrates, manganese doped zinc sulphide or manganese doped zinc selenide phosphor material. It relates to the manufacture of both ac electroluminescent, and dc electroluminescent types of panel.

BACKGROUND ART

The phosphor material, manganese doped zinc sulphide, has been incorporated in fine particle powder form as a layer enclosed between electrode bearing substrates. In particular there is a dc electroluminescent panel that incorporates copper coated particles of this material, a material that is activated by a preliminary process of electrical forming. During this process, as the layer becomes heated by the dissipation of primary current, copper migrates away from one of the electrode bearing substrates leaving a thin region of high resistivity, a region depleted of copper. In the subsequent operation of this panel, it is this thin region that serves as the electroluminescent source.

An alternative to this structure, a two layer structure comprising a thin active layer of manganese doped zinc sulphide powder and, in intimate contact with this, a thicker layer of copper coated zinc sulphide powder, is described in GB. Patent No. 1,571,620. Priming by the process of electrical forming, is obviated since both high resistivity and low resistivity regions, two layers, are provided during manufacture.

In both the structures described above, the presence of mobile copper has a stabilising effect. Any anomalously low resistivity part of the high resistivity region that develops, causes localised heating and a migration of copper, resulting in correction of local resistivity.

Higher efficiency, ie better luminance, may be achieved, using instead of powdered phosphor, a relatively thin film of phosphor material for the high resistivity layer. It is however difficult to produce uniform flawless thin film, and device yield and lifetime is low. For example, a pinhole flaw in the film can lead to high localised heating, arcing, and catastrophic disruption of the film. However, attempts to produce manganese doped zinc sulphide film—eg by sputter implantation of manganese in preformed zinc sulphide film—have to date proved ineffectual for dc electroluminescent panel construction.

A conventional ac thin film electroluminescent panel (ACTFEL) is comprised of a thin phosphor film sandwiched between a pair of insulated electrode bearing glass substrates. Thin film ZnS:Mn devices are now in commercial use. Hitherto the favoured methods of depositing thin films of ZnS:Mn have been by sputtering or electron beam (E-beam) evaporation. In both cases a subsequent heat treatment at 450° C. is normally necessary to provide acceptable luminescent film quality. Current state of art devices emit a mean luminance of about 20 ft L, when driven with 0.5% pulses exceeding 200 V peak magnitude. Attempts to reduce drive voltage by making thinner films yield lower (and therefore unacceptable) brightness.

DISCLOSURE OF THE INVENTION

The invention is intended to provide a method for the manufacture of an electroluminescent panel of good stability and high luminant efficiency.

Accordingly there is provided a method for the manufacture of an electroluminescent panel wherein manganese doped zinc chalcogenide phosphor film is grown by exposing a heated electrode bearing substrate to alkyl zinc vapour and a gaseous hydride of one of the chalcogen elements sulphur or selenium, in the presence of tricarbonyl alkylcyclopentadienyl manganese vapour.

This method results in chemical vapour deposition of the chalcogenide and this is accompanied by diffuse and uniform introduction of the manganese dopant ion species, which latter results from decomposition of the tricarbonyl compound vapour at the elevated temperature of the substrate.

The phosphor film material may be a binary compound, either manganese doped zinc sulphide or manganese doped zinc selenide each grown using the appropriate hydride-hydrogen sulphide or hydrogen selenide.

Alternatively the phosphor film material may be a ternary compound, for example, one of the following manganese doped compounds: zinc sulphur selenide, zinc oxy-sulphide, zinc oxy-selenide or zinc cadmium sulphide. In each of these examples the chalcogenide is electrically insulating and exhibits an energy bandgap in excess of 2.2 eV and thus suitable as host for the manganese ions. The first of these examples—zinc sulphur selenide—may be grown by reacting the alkyl zinc vapour with an admixture of hydrogen sulphide and hydrogen selenide.

The alkyl zinc is in preference dimethyl zinc, but diethyl zinc and (vapour pressure permitting) higher alkyls could be used as alternative.

The tricarbonyl alkylcyclopentadienyl manganese compound has the following chemical structure:

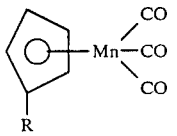

where here R denotes the alkyl radical. Preferably, this compound is tricarbonyl methylcyclopentadienyl manganese:

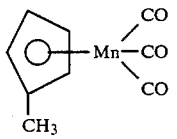

but the ethyl compound may be used as alternative.

BRIEF INTRODUCTION OF THE DRAWINGS

In the accompanying drawings:

FIG. 1: illustrates in cross-section a film-powder composite dc electroluminescent panel;

FIGS. 2 and 3: illustrate apparatus for use in the manufacture of the panel shown in the preceding figure;

FIG. 4: illustrates in cross-section a thin film ac electroluminescent panel; and, FIG. 5: is a graph depicting ac panel brightness as a function of applied signal peak voltage.

DESCRIPTION OF EMBODIMENTS

Embodiments of the invention will now be described, by way of example only, with reference to the accompanying drawings.

Figure 1:
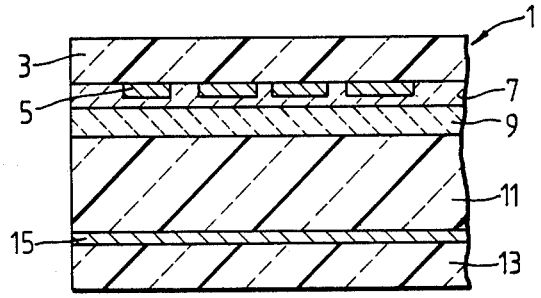

A film-powder composite dc electroluminescent panel 1 is shown in FIG. 1. This is comprised of a first glass plate substrate 3 bearing shaped electrodes 5. These shaped electrodes 5 are of tin oxide conductive material produced by the photolithographic definition and etching of a deposited film, in a conventional manner. Over these electrodes 5 there has been deposited a very thin protective film 7 of zinc sulphide, a film a few hundred Angstroms thick. This is provided to protect the tin oxide material from chemical attack during the latter processing during which a thin film 9 of manganese doped zinc sulphide {eg 0.4 μm thick} is deposited at a higher deposition temperature. This latter thin film 9, which serves as the electroluminescent source, is backed by a thick powder layer 11, typically 50 μm thick, of copper coated zinc sulphide particles (see UK Pat. No. 1,300,548) and an electrode bearing plate glass substrate 13. This latter substrate 13 carries a sheet electrode 15 of aluminium film, a film that has been deposited over its surface. Intimate electrical contact is provided between the conductive powder layer 11 and the high resistivity phosphor film 9.

Figure 2:
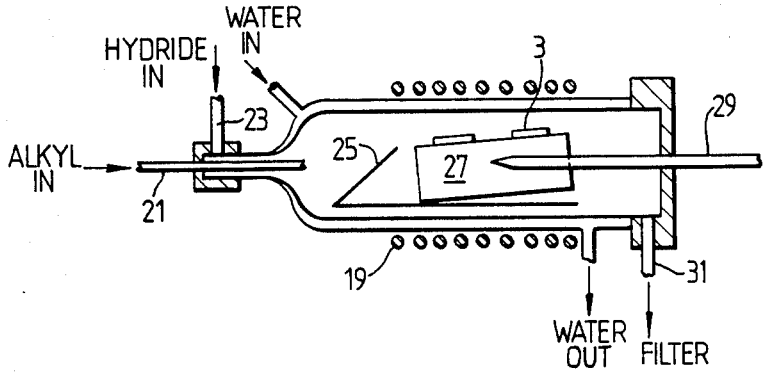

The manganese doped zinc sulphide film 9 has been produced by an organometallic chemical vapour deposition technique using an admixture of gaseous hydrogen sulphide and vapours of dimethy zinc and tricarbonyl methyl-cyclopentadienyl manganese as detailed below. Apparatus used for the deposition of zinc sulphide and manganese doped zine sulphide film is shown in FIG. 2. This apparatus is of conventional design and is of the type used for the deposit of pure zinc sulphide—see J. Crystal Growth Vol. 31 p. 172 (1975). It is comprised of a water cooled reaction vessel 17 about which is wound an induction coil 19. The vessel 17 has two inlets 21, 23 one to admit alkyl vapour, the other to admit gaseous hydride. Inside the vessel there is a liner 25 and on this there is mounted a graphite pedestal susceptor 27. This pedestal carries one or more of the electrode bearing substrates 3. The growth temperature is monitored using a thermocouple 29 coupled to the susceptor 27. Excess gases and vapours, as also waste gaseous products of reaction, are extracted from the vessel through a filter connected to a vessel outlet, outlet 31, at the remote end of the vessel.

Figure 3:
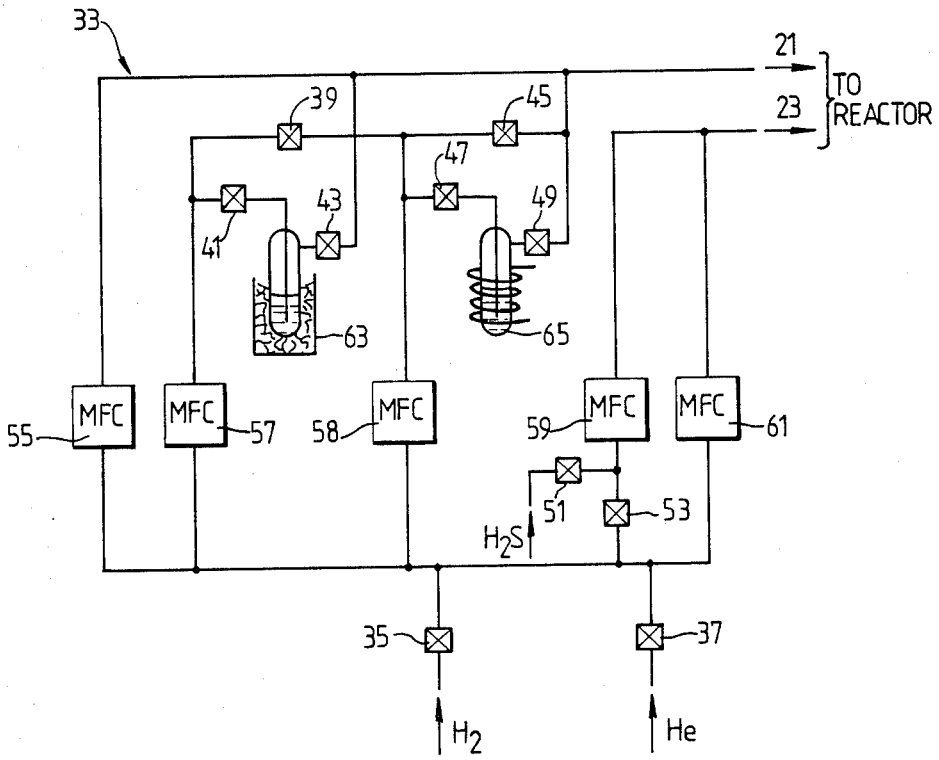

The reactor vessel inlets 21 and 23 are connected to a gas flow system 33 which is shown in FIG. 3. This system is comprised of a number of control taps 35 to 53, mass flow controllers 55 to 61, containment vessels 63, 65 for the liquid components, the alkyldimethyl zinc and the dopant reagent tricarbonyl methyl cyclopentadienyl manganese, and gas bottles 67, 69 and 71 for the hydride reagent-hydrogen sulphide, a carrier gas (purified hydrogen) and a flushing gas (dry helium), arranged as shown.

At the start of the process, the reaction vessel is flushed with purified hydrogen (Tap 37 closed, taps 35, 39, 45 and 53 open). After adequate time has been allowed for flushing, the induction coil 19 is energised and the substrate temperature raised to operating level, 350° C. or above. In the next stage of the process, pure zinc sulphide film deposition is commenced.

Dimethyl zinc vapour is generated by bubbling purified hydrogen through cooled alkyl liquid contained in the containment vessel 63 (tap 39 closed, taps 21 and 43 open) this vapour is then mixed with the gaseous carrier (purified hydrogen), in appropriate proportion controlled by the mass flow controllers 55 and 57, and admitted into the reaction vessel 17 at inlet 21. At the same time, an admixture of the hydride (hydrogen sulphide gas) and purified hydrogen is admitted at inlet 23 of the reaction vessel 17 (tap 53 closed, tap 51 open). The appropriate proportion of these gases is controlled by the mass flow controllers 59 and 61. The alkyl and hydride reagents react at the substrate surface, and the reaction product zinc sulphide is deposited as a ffilm over this surface:

$$(CH_3)_2Zn + H_2S \xrightarrow[350^\circ\ C.]{} ZnS + 2CH_4$$

Excess gases, carrier gas and the gaseous waste product methane are continuously extracted at the vessel outlet 31.

After sufficient time for deposit of a very thin protective film—a film of thickness a few hundred angstroms—the next stage of the process—doped film deposit is commenced, and the substrate temperature is raised to approximately 400° C. The liquid manganese compound-tricarbonyl methyl-cyclopentadienyl manganese which is stored in a stainless steel cylinder—the containment vessel 65—is maintained at a suitable temperature to give adequate vapour pressure above the liquid surface. This vapour is transported by bubbling purified hydrogen through the liquid and passing the saturated vapour through heated pipework to the reaction vessel 17 where it is admitted with the alkyl vapour at inlet 21. The appropriate proportion of manganese is controlled by the mass flow controller 58. (Tap 45 closed, taps 47 and 49 open).

After further time, sufficient for deposit of a thin doped film, the transport of the vapours and gases is terminated and the remaining vapours and gases flushed out of the reaction vessel. (Taps 41, 43, 47, 49, 51 closed, taps 39, 45, 53 open).

Typical process data is detailed as follows:

| | | |
|---|---|---|
| Flow rates | | |
| $H_2S$ 5% mixture in $H_2$ | 20 cc/min | $2.2 \times 10^{-4}$ mole fraction |
| Dimethylzinc | 5 cc/min | $1.08 \times 10^{-4}$ mole fraction |
| Bubbler at −10° C. | | |
| Total flow ($H_2$) | 4.5 L/min | |
| manganese compound (75° C.) | 25 cc/min | |

| | |
|---|---|
| Substrate temperature | 400° C. for Mn doped ZnS layer<br>350° C. for optional ZnS layer |
| Reaction time | ≃ 15 minutes at growth temperature<br>≃ 20 minutes flush with $H_2$ before growth<br>≃ 10 minutes $H_2$ flush after growth |
| Manganese bubbler temperature 75° C. with a hydrogen flow of 25 cc/min through the bubbler | |
| Film thickness | Thickness of ZnS (Mn) layer ≃ 0.4 μm<br>Thickness of ZnS undoped layer (very thin, a few hundred Angstroms) |
| Dopant concentration of Mn in ZnS ≃ 0.14 wt % Mn | |

Higher manganese dopant concentration may be achieved by operating the manganese bubbler at higher temperature. Eg a bubbler temperature of 115° C. gives a dopant concentration ≃0.4 wt % Mn.

Other conditions being maintained.

The lower temperature deposit of undoped zinc sulphide is an optional step in this process. It is found that dimethyl zinc will react significantly with the electrode material at the elevated temperature of 400° C. The layer of undoped zinc sulphide thus serves as a chemical barrier. This step may be omitted, provided that admission of the dimethyl zinc is delayed.

Panels produced using this process in their manufacture have been tested and their brightness performance is summarised in the following table.

TABLE I

Current vs Brightness for an area ~0.1 $cm^2$, Current-Brightness results, for an area of ~0.1 $cm^2$ and a Mn concentration of ~0.1 wt %, have been found as follows:

| I(mA) | ($Cdm^{-2}$) |
|---|---|
| 5 | 86 |
| 10 | 170 |
| 15 | 246 |
| 20 | 304 |
| 25 | 365 |
| 30 | 403 |
| 40 | 470 |
| 50 | 531 |
| 60 | 595 |
| 70 | 646 |

Figure 4:
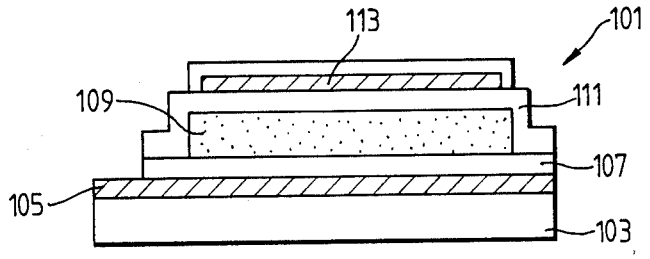

This method of depositing manganese-doped zinc sulphide film may also be applied to the manufacture of ac electroluminescent panels:

There is shown in FIG. 4, an ac electroluminescent panel 101 including a thin film deposited by the method described above. This panel 101 comprises a first glass plate substrate 103 bearing an electrode structure 105 formed from a conventional deposit of cadmium stannate material. This electrode structure 105 is insulated by a thin film covering 107 of sputtered silicon nitride $Si_3N_4$, a film approximately 5000 Å thick. On this film 107, the manganese-doped zinc sulphide thin film phosphor 109 has been deposited by the method described. This latter thin film 109 is covered by a second sputter film 111 of silicon nitride, also approximately 5000 Å thick. A second electrode structure 113, a sheet electrode of evaporated aluminium film is formed over the back surface of this latter nitride film 111.

Figure 5:
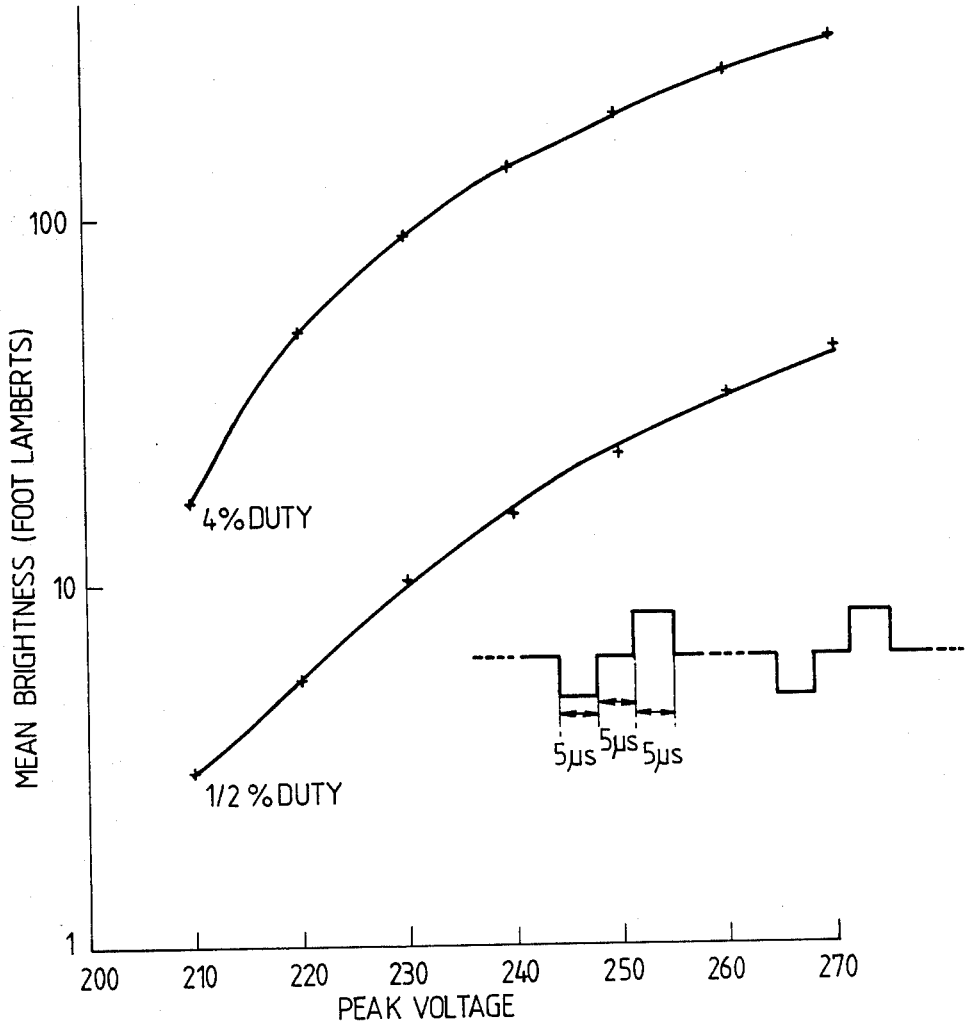

An ac electroluminescent panel having the structure described, has been tested and the performance measured. The measured current-brightness characteristic of this panel is depicted in FIG. 5. For these measurements, an arbitrarily chosen (ie non-optimised) drive waveform was used to excite the panel. The waveforms of the applied voltage signal comprised a negative 5 μs pulse followed, after a 5 μs delay, by a positive 5 μs pulse. This pattern was repeated at 2 ms and 250 μs intervals, respectively, to give duty cycles of 0.5% and 4%. The results obtained for different peak voltages and for the two values of duty cycle are shown. It is noted that, at 290 volts peak, and 0.5% duty cycle, a very high mean brightness of 315 cd/$m^2$ (90 ft L) was obtained.

We claim:

1. A method for the manufacture of an electroluminescent panel wherein manganese doped zinc chalcogenide phosphor film is grown by exposing a heated electrode bearing substrate to alkyl zinc vapour and a gaseous hydride of one of the chalcogen elements sulphur or selenium, in the presence of tricarbonyl alkylcyclopentadienyl manganese vapor.

2. A method as claimed in the preceding claim wherein tricarbonyl methylcyclopentadienyl manganese is used.

3. A method as claimed in claim 1 wherein dimethyl zinc is used.

4. A method as claimed in claim 1 wherein gaseous hydrogen sulphide is used.

5. A method as claimed in claim 1 wherein gaseous hydrogen selenide is used.

6. A method as claimed in claim 1 wherein an admixture of gaseous hydrogen sulphide and hydrogen selenide is used.

7. A method for the manufacture of an electroluminescent panel wherein manganese doped zinc sulphide phosphor film is grown by exposing an electrode bearing substrate, heated to a temperature in excess of 350° C., to dimethyl zinc vapour and gaseous hydrogen sulphide in the presence of tricarbonyl methylcyclopentadienyl manganese vapour.

* * * * *